US005276493A

United States Patent [19]

Hediger et al.

[11] Patent Number: 5,276,493

[45] Date of Patent: Jan. 4, 1994

[54] HYDRAULIC WIDE NIP FLEX SLEEVE FUSER

[75] Inventors: Edwin A. Hediger, Fairport; William J. Staudenmayer, Pittsford, both of N.Y.

[73] Assignee: Eastman Kodak Company, Rochester, N.Y.

[21] Appl. No.: 970,442

[22] Filed: Oct. 29, 1992

Related U.S. Application Data

[63] Continuation of Ser. No. 705,688, May 24, 1991, abandoned.

[51] Int. Cl.[5] ..... G03G 15/20

[52] U.S. Cl. ..... 355/290; 219/216; 355/295

[58] Field of Search ..... 355/290, 295, 282; 219/216, 469-; 432/60; 118/60, 115, 116

[56] References Cited

U.S. PATENT DOCUMENTS

| | | | |
|---|---|---|---|
| 4,258,095 | 3/1981 | Larson et al. | 118/115 X |
| 4,377,336 | 3/1983 | Parks et al. | 219/216 X |
| 4,501,482 | 2/1985 | Stryjewski | 355/290 |
| 4,553,826 | 11/1985 | Mosholder | 355/295 |
| 4,814,819 | 3/1989 | Torino et al. | 355/295 |
| 4,949,130 | 8/1990 | Torino | 355/290 X |

FOREIGN PATENT DOCUMENTS

| | | |
|---|---|---|
| 53-143324 | 12/1978 | Japan . |
| 56-4171 | 1/1981 | Japan . |
| 56-107279 | 8/1981 | Japan . |

*Primary Examiner*—A. T. Grimley
*Assistant Examiner*—Shuk Y. Lee
*Attorney, Agent, or Firm*—Leonard W. Treash

[57] ABSTRACT

An apparatus including a fixing assembly for fixing an image onto a medium as the medium travels in a path through the assembly, the fixing assembly having a wide nip along the path of travel of the medium formed by a pair of nip forming rollers, at least one of which rollers contains a hydraulic fluid and maybe heated. The hydraulic roller has an aluminum core encased in a sealed stainless steel flexible hydraulic sleeve. In the space between the core and sleeve of each roller is a pressurized fluid. The apparatus also has a hydraulic piston for pressurizing the fluid.

12 Claims, 3 Drawing Sheets

HYDRAULIC WIDE NIP FLEX SLEEVE FUSER

This is a continuation of application Ser. No. 705,688, filed May 24, 1991, now abandoned.

BACKGROUND OF THE INVENTION

The instant invention relates to an apparatus and process for fixing toners or other materials on a medium. Subsequent to development of an image, the developed image is transferred to a receiving medium. After the transfer to the receiving medium, pressure and/or heat are applied to the receiving medium as the receiving medium and the developed image pass through a nip formed by a pair of rollers. By pressure and/or heat being applied, at the nip, to the receiving medium, the developed image is permanently fixed to the receiving medium.

As in any apparatus for fixing toners or other materials, the feeding and contact parameters, as the receiving medium passes through the nip, are critical. Without the proper feeding and contact parameters various problems, in and about the nip, result such as:

1. Defects in the fixed image caused by localized stresses in the nip mechanics during the fixing process.
2. Inefficient thermal conductivity for internally heated rollers causing an increase in the time needed for the fixing roller to reach operational temperatures.
3. Nip width directly related to the fixing pressure.
4. Excessive drive torque that creates paper grab and deformation.
5. Velocity changes in the nip causing image distortion.
6. Static charge in the nip causing image distortion.
7. Excessive roller wear.
8. Artifacts such as rivers and lakes or toner smear caused by local stress in the nip.
9. An arched nip resulting in paper curl or loss of paper stiffness.
10. The need for large rollers to create wide flat nips.

In the past, to avoid feeding and contact problems, such as above stated, and to prevent the movement of the toner particles and the localized stress that caused defects or distortion of a image, one would change the compliancy of one or more of the rollers in the fixing assembly to lessen the effect of such process-related defects. Attempts made to increase the compliancy and to thereby lessen the fixing related image defects included making the elastomeric layers thicker and using an elastomeric foam material such as disclosed in U.S. Pat. No. 4,814,819. However, since fixing rollers are usually heated internally, it was difficult to obtain an elastomeric material that was sufficiently compliant while having a heat conductivity that efficiently provided the necessary heat to fix the toner images. Therefore, these attempted solutions proved unsatisfactory.

SUMMARY OF THE INVENTION

The present invention, while general to the field of toner fixing on a receiving medium, more particularly relates to a fixing assembly for fixing an image onto a medium as the medium travels in a path through the fixing assembly. The fixing assembly has a wide nip along the path of the travel of the receiving medium, formed by a pair of nip forming rollers, because at least one of said roller contains a hydraulic fluid. An embodiment of the invention also provides for means to pressurize the hydraulic fluid contained within the roller or rollers. The outer surface of a roller containing hydraulic fluid is preferred to be of a stainless steel sleeve construction, and the sleeve may be coated with a layer of silicone rubber to assist in compliance and to prevent toner from sticking to said sleeve.

It is, therefore, an object of the present invention to cure the problems of the prior art by providing a fixing assembly having the following features:

1. Minimal defects in the fixed image caused by localized stresses in the nip mechanics during the fixing process.
2. Efficient thermal conductivity for internally heated rollers, thereby reducing the time needed for the heated roller to reach operational temperatures.
3. A nip width minimally related to the fixing pressure.
4. Reduced nip drive torque with minimal paper grab and deformation.
5. Virtually no velocity change in the nip.
6. Virtually no static charge in the nip.
7. Virtually no roller wear.
8. Virtually no artifacts such as rivers and lakes or toner smear.
9. A symmetrical flat nip to prevent paper curl or lost of paper stiffness.
10. A compact unit, using small rollers, capable of having a wide flat nip width.

The present invention obtains these desired results by providing a mechanism that has a flat nip formed between two rollers either or both of which may be heated. Either or both of the rollers being formed of a central core of aluminum with an outer flexible sleeve of stainless steel. A hydraulic fluid fills the space that separates the core from the sleeve. The hydraulic pressure exerted by the hydraulic fluid, when both rollers contain such fluid, is adjusted to approximately the same value. Separating the core and sleeve of each roller are two lip seals that contain the hydraulic fluid and keep the core and sleeve in a nonslip frictional relation so that the sleeve rotates with the core.

Accordingly, the instant invention provides an improvement to the fixing assembly of an apparatus by accomplishing the aforesaid ten (10) objects.

DESCRIPTION OF THE PREFERRED EMBODIMENT OF THE INVENTION

Figure 1:
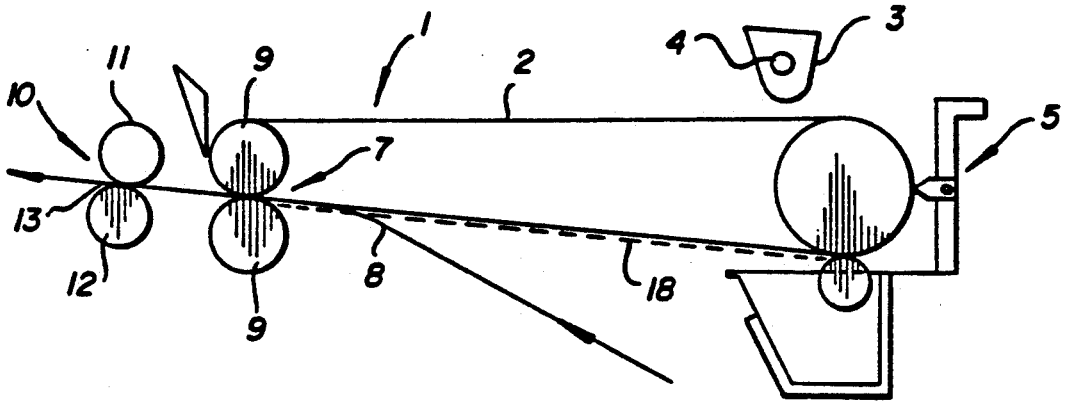
FIG. 1 (PRIOR ART)
FIG. 1 is a sectional end view of a prior art electrophotographical apparatus.

In describing the preferred embodiment, which by way of example, but not by way of limitation, is illustrated in relation to an electrophotographic copying apparatus, reference is made to the drawings, wherein like numerals indicate like parts and structural features in the various views, diagrams and drawings. FIG. 1 schematically shows the typical stations of an electrophotographic copying apparatus. A photoconductive belt 1, containing a photosensitive image surface 2, is sensitized by charger 3 comprised of a corona-generating device 4. The photosensitive image surface 2 is sensitized prior to being exposed at exposure station 5, to the image to be copied. The exposed photosensitive image surface 2 of photoconductive belt 1 is then passed through development station 6 for toning. After tuning, the image is transferred, at transfer station 7, from the photoconductive belt 1 to a receiving medium 8. Receiving medium 8 bearing the toned image is then stripped from the photoconductive belt 1, subsequent to transfer rollers 9 of transfer station 7. Once transfer is complete, receiving medium 8 and its developed image is conveyed to a fixing station 10 which is comprised of a heated roller 11 and a pressure roller 12. The image is fixed at fixing station 10 to the receiving medium 8 by the heat and pressure contained within nip 13 between rollers 11 and 12, and the receiving medium 8 is discharged to a catch tray, not shown, for collection by the operator.

Figure 2:
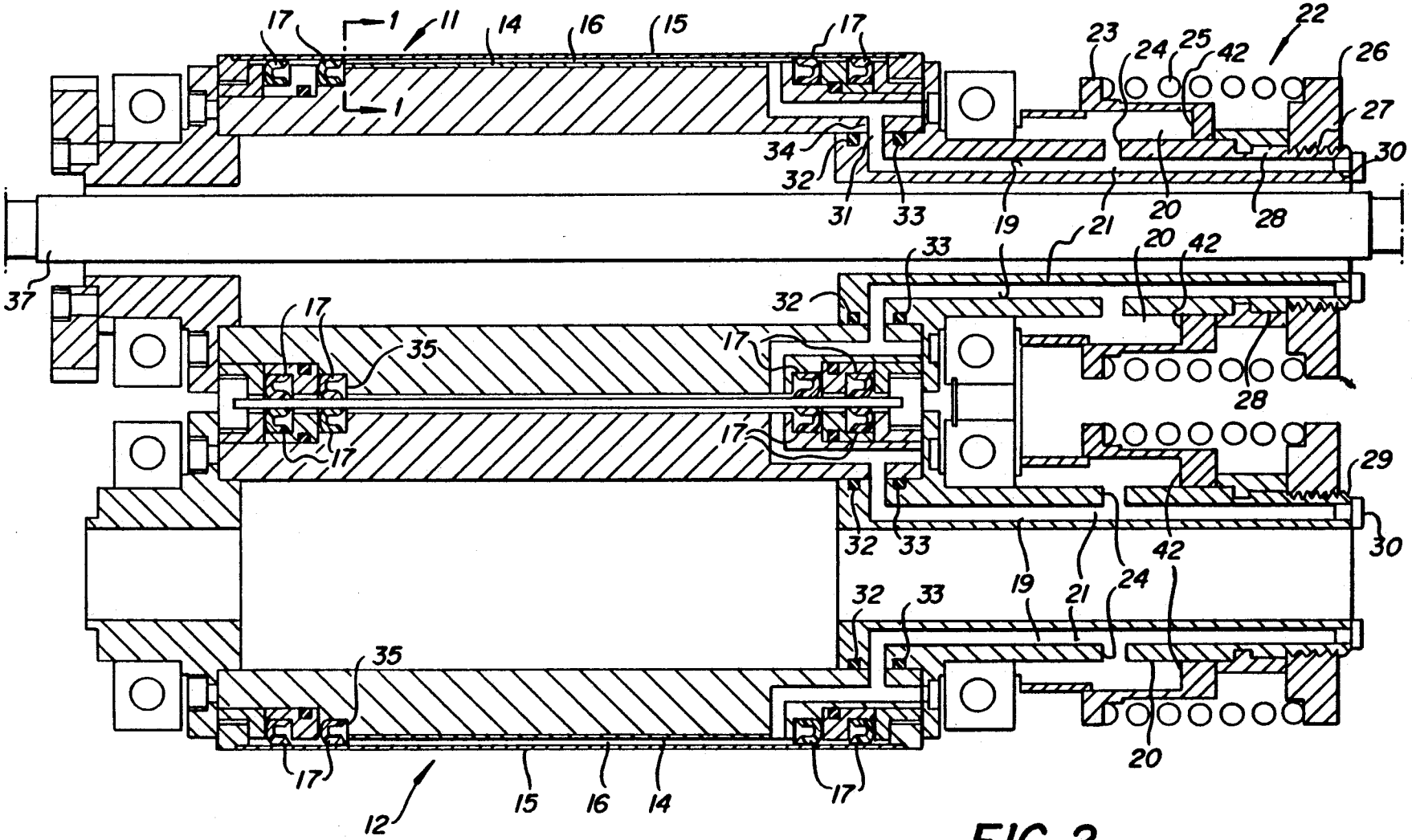
FIG. 2 is a sectional front view of a heated fixing roller and pressure roller.

Referring to FIG. 2, a preferred embodiment of the present invention, while using the above known process, improves upon the fixing station 10 by having at least one of either the fixing roller 11 or the pressure roller 12 constructed of an inner aluminum or similar metal core 14 with a flexible outer stainless steel or similar metal sleeve 15 having a thickness in the 0.003 to 0.007 inch range. The flexible stainless steel sleeve 15 may be coated with a thin layer of silicone rubber having a thickness in the 0.010 to 0.040 inch range to prevent the toner from sticking to the stainless steel sleeve 15 and to provide compliance for variations in toner pile height 18.

Figure 4:
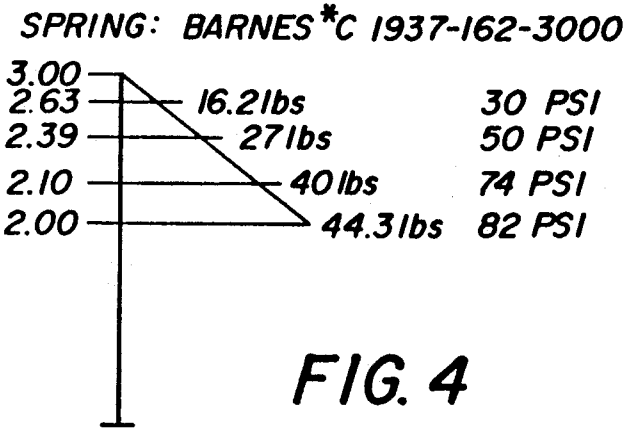
FIG. 4 is a chart of spring tension as it relates to the pressure created by the hydraulic fluid contained within the rollers.
Figure 6:
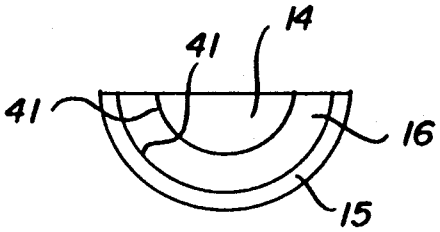
FIG. 6 is an enlarged sectional view through section 1—1 of FIG. 1 showing the end of cavity 16 where lip seals 17 make mating contact with the ends of the core and sleeve of the roller.
Figure 3:
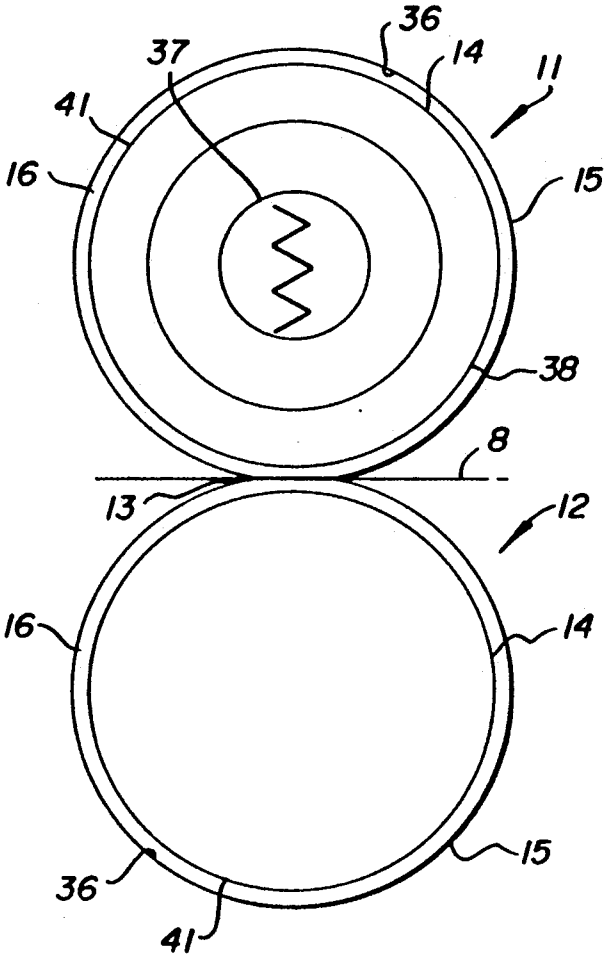
FIG. 3 is a sectional end view of a nip formed by the fixing and pressure rollers of the invention.

As shown in FIGS. 2 and 3, located between core 14 and sleeve 15 is cavity 16. Cavity 16 is formed by the lip seals 17 mating with the ends 41 of core 14 and sleeve 15 as shown in FIG. 6. Cavity 16 contains a pressurized noncompressible fluid 19 such as silicone. Pressurized fluid 19 is introduced to cavity 16 from reservoir 20 and flows from reservoir 20 to cavity 16 through channel 21. The pressure caused by fluid 19 in cavity 16 is controlled by pressure adjustment assembly 22 consisting of piston 23, acting on fluid 19 in reservoir 20 through ram 42 and connected to channel 21 through channel 24. When one exerts a force upon a ram 42 by movement of piston 23, fluid 19 contained within reservior 20 is forced into the channel 24 by ram 42. When the extra fluid 19 from reservoir 20 is forced through channel 24, said fluid 19 flows through channel 21 into cavity 16 whereupon it increases the pressure on flexible sleeve 15 in the ratios shown in FIG. 4. One way of exerting a force on piston 23 and ram 42, is spring 25. Spring 25 creates a bias between piston 23 and adjustment nut 26. Adjustment nut 26, when moved in a clockwise motion, increases the bias on piston 23 through spring 25 and thereby causing ram 42 to cause fluid 19 in reservoir 20 to flow through channel 24 and increase the pressure within rollers 11 and 12. When moved in a counterclockwise motion, adjustment nut 26 decreases the bias on piston 23 through spring 25 which in turn causes a decrease in the pressure within rollers 11 and 12. Adjustment nut 26 is capable of holding spring 25 in an infinite number of biasing positions by being in frictional contact with threads 27 located on the outer circumference 28 of channel 21. To prevent fluid 16 from leaking at channel groove 31, where channel 21 mates with internal channel 34, located within rollers 11 and 12, O-rings 32 and 33 are provided. O-rings 32 and 33 are located on each side of channel groove 31.

The lip seals 17, preferable are made of high temperature VITON, because of their tapered ends 35 and their U shape design, upon coming into contact with fluid 19, expand toward the outer surface of aluminum core 14 and inner surface of stainless steel sleeve 15. This expansion increases the sealing capacity as the pressure exerted by fluid 19 increases. Lip seals 17 also create a frictional seal between core 14 and sleeve 15 so that sleeve 15 is caused to rotate with core 14 as core 14 is driven by a drive mechanism, not shown. In addition, located at one end 29 of channel 21 is filler plug 30 which can be removed from channel 21 to add fluid 19 to or remove fluid 19 from reservoir 20.

Figure 5:
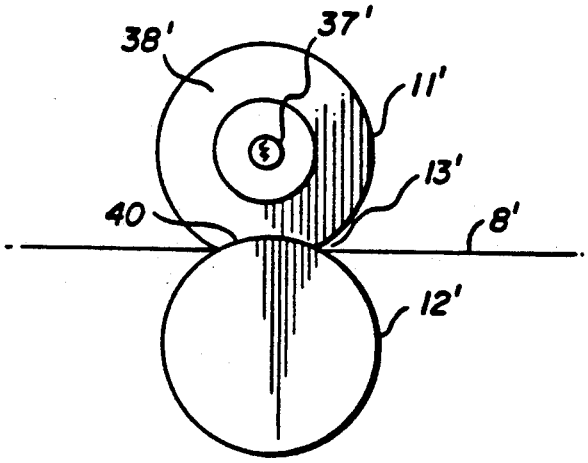
FIG. 5 (PRIOR ART)
FIG. 5 is a schematic side view of the fixing and pressure rollers of a prior art electrophotographical apparatus.

In operation the nip width 13 formed by rollers 11 and 12 increases in size, along the path of travel of the receiving medium 8, as the pressure within cavity 16 is reduced. If one, therefore, compares the prior art fixing station, as shown in FIG. 5, with the fixing station of the present invention, as shown in FIG. 3, it is clear that nip 13 of the present invention is flatter then nip 13' of the prior art. The reason that nip 13 is flatter than nip 13', even when using the same size or smaller rollers, is because the pressure exerted by the hydraulic fluid 19 on sleeve 15 of both rollers 11 and 12 can be adjusted independently. Therefore, the outer circumference of both roller 11 and 12, unlike the prior art, establish a flat compliant nip 13 as opposed to a curved nip 13'. In addition, since the pressure in the hydraulic roller 11 and 12 can be changed through adjustment nut 26, the compliance of rollers 11 and 12 can be changed at any time without the need to change the rollers 11 and 12 as had to be done in the past to change compliancy. This allows receiving medium 8, as it passes through nip 13, to maintain itself in a single plane, thereby reducing localized stress to receiving medium 8. However receiving medium 8', since it must travel in multiple planes as it goes through nip 13', is subjected to higher localized stress. In addition, since hydraulic rollers, as opposed to solid or hard rollers, are able to adapt between the thicker areas on the receiving paper, i.e., those containing the receiving image, and the thinner areas, i.e., those not containing any receiving image, the cause of local stress is further minimized.

In the present invention there is a maximum transfer of heat from internal heat lamp 37 as opposed to the heat transferred from internal heat lamp 37', since the thin layer of hydraulic fluid 19 in cavity 16 conducts heat better than the thicker elastomer or foam material 38 located between the internal heat lamp 37' and the outer surface of roller 11'. This maximum transfer of heat allows the fixing assembly to quickly reach operating temperature.

The nip width 13, in the present invention, increases with the lowering of the pressure caused by fluid 19, since the outer surfaces of flexible sleeves 15, of rollers 11 and 12, become more compliant with a reduction in pressure. While this increase in compliance of flexible sleeves 15 is due to decreases in internal pressure, rollers 11 and 12 still maintain a sufficient pressure on receiving medium 8 as it passes through nip 13 to insure high quality toner fixing. This is unlike the situation of rollers 11′ and 12′ which require an increase in pressure to create a wider nip 13′. However, with an increase in pressure between rollers 11′ and 12′, without maintaining compliance between rollers 11′ and 12′, nip 13′ cannot maintain a single plane of travel for receiving medium 8, thereby subjecting the image on receiving medium 8 to fixing distortions.

Further, in the present invention, the torque required to drive rollers 11 and 12 is less than that required to drive rollers 11′ and 12′, since roller 12 doesn't break the plane of roller 11, as does roller 12′ with roller 11′.

Still further, in the present invention, there is minimal velocity change within nip 13 thereby minimizing the stress placed upon receiving medium 8 while traveling in nip 13, since receiving medium 8 continues to maintain its travel in a single plane, prior to, while in and subsequent to nip 13. Copy medium 8′, however, must travel faster in the arch 40 of nip 13′ as opposed to its single plane travel both prior and subsequent to nip 13′ to avoid the stress caused by the difference in feeding and retarding forces of the entrance and exit of nip 13′ and those in the arch 40 of nip 13′. The single plane travel, of the present invention, also reduces the static charge, paper curl, loss of paper stiffness and river and lake effects of the prior art, since the rubbing caused by multiplane travel is eliminated in single plane travel, thereby reducing the causes of the above-stated problems.

While the present invention has been described with the reference to the particular structure disclosed herein, it is not intended that it be limited to the specific details and this application is intended to cover such modifications or changes as may come within the purposes of the improvements or scope of the claims forming a part hereof.

What is claimed is:

1. An apparatus having a fixing assembly for fixing an image onto a medium as the medium travels in a path through the fixing assembly, the fixing assembly having a wide nip along the path of travel of the medium, formed by a pair of nip forming rollers with at least one of said rollers containing a hydraulic fluid between an inner core and an outer flexible sleeve for adjusting a nip width along the path of travel of the medium by increasing or decreasing the hydraulic fluid internally contained within said roller and thereby changing a compliancy of the outer flexible sleeve.

2. The apparatus of claim 1 wherein one of the rollers is heated.

3. The apparatus of claim 1 wherein each roller has a core encased in a metal flexible sleeve with the hydraulic fluid located between the core and the metal flexible sleeve.

4. The apparatus of claim 3 wherein the the metal flexible sleeve is stainless steel.

5. The apparatus of claim 3 wherein a sealing means located between the core and the metal flexible sleeve contains the hydraulic fluid.

6. The apparatus of claim 5 wherein the sealing means comprises a plurality of lip seals.

7. The apparatus of claim 3 wherein a means is provided to increase and decrease an amount of hydraulic fluid located between the core and the outer sleeve.

8. An apparatus having a fixing assembly for fixing an image onto a medium as the medium travels in a path through the assembly, the fixing assembly having a wide nip, along the path of travel of the medium, formed by a pair of nip forming rollers, wherein the nip forming rollers are comprised of a metal core encased in a flexible stainless steel sleeve, located internally within said nip rollers, between the core and the flexible stainless steel sleeve is a cavity that contains a hydraulic fluid; the hydraulic fluid is prevented from leaking from the cavity between the core and the flexible stainless steel sleeve by a plurality of lip seals located between the core and the stainless steel sleeve, connected to the cavity is a means to supply and remove hydraulic fluid from the cavity for adjusting a nip width along the path of travel of the medium by changing a compliancy of the flexible stainless steel sleeve.

9. The apparatus of claim 8 wherein the means to supply and remove hydraulic fluid from the cavity is a cylinder containing hydraulic fluid, within said cylinder is a ram and said ram is biased by a spring to control movement of the ram within the cylinder.

10. The apparatus of claim 7 wherein a pressure increase on the flexible sleeve and the core is a result of an increase in the amount of hydraulic fluid located between the core and the flexible sleeve.

11. The apparatus of claim 10 wherein the same means to increase and decrease the amount of hydraulic fluid and the pressure between the core and the flexible sleeve also regulates the roller's compliance.

12. The apparatus of claim 10 wherein the compliance of the roller may be changed without removal of the rollers from the apparatus.

* * * * *